United States Patent [19]

Desmarais et al.

[11] 4,417,115

[45] Nov. 22, 1983

[54] SWITCH ACTUATING ASSEMBLY HAVING IMPROVED CAMS AND PLURAL MODES

[75] Inventors: Mark R. Desmarais, Derry; Mark A. Yates, Chelmsford, Mass.

[73] Assignee: AMP Incorporated, Harrisburg, Pa.

[21] Appl. No.: 354,318

[22] Filed: Mar. 3, 1982

[51] Int. Cl.[3] ..... H01H 3/12; H01H 3/00

[52] U.S. Cl. ..... 200/340; 200/5 A; 200/153 J; 200/159 B

[58] Field of Search ..... 200/159 B, 240, 153 J, 200/160, 318, 328, 5 A; 400/477, 479, 479.1, 479.2, 491.2

[56] References Cited

U.S. PATENT DOCUMENTS

| | | | |
|---|---|---|---|
| 3,773,997 | 11/1973 | Evans et al. | 200/159 B |
| 3,856,998 | 12/1974 | Sims, Jr. | 200/159 B X |
| 3,934,104 | 1/1974 | Stout | 200/159 R |
| 4,052,582 | 10/1977 | Mullen et al. | 200/330 |
| 4,112,277 | 9/1978 | Kleeb | 200/153 J |
| 4,117,292 | 9/1978 | Hayes et al. | 200/340 |
| 4,132,877 | 1/1979 | Daigle | 200/159 R X |
| 4,161,637 | 7/1979 | Priesemuth | 200/153 J |
| 4,249,053 | 2/1981 | Tsutsui | 200/159 R |

FOREIGN PATENT DOCUMENTS

| | | | |
|---|---|---|---|
| 25629 | 3/1981 | European Pat. Off. | 200/159 B |

*Primary Examiner*—Stephen Marcus
*Assistant Examiner*—Ernest G. Cosick
*Attorney, Agent, or Firm*—Frederick W. Raring

[57] ABSTRACT

A switch actuating assembly for a keyboard switch comprises a frame and plunger slideably mounted on the frame. The plunger has an integral deflectable camming arm extending parallel to the frame from its upper end. The camming arm engages a cam on the frame during depression of the plunger to provide tactile effect when the switch is closed. The plunger can be assembled to the frame in any one of three orientations to provide the tactile effect, to provide a shift locking effect, or to permit closing of the switch without tactile effect.

13 Claims, 18 Drawing Figures

Fig. 2
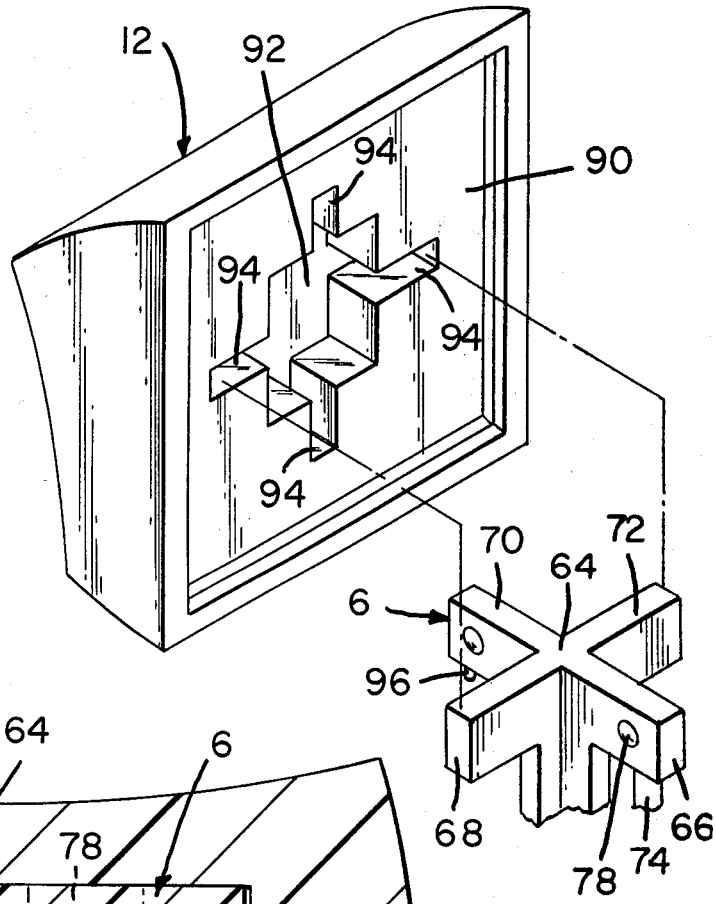
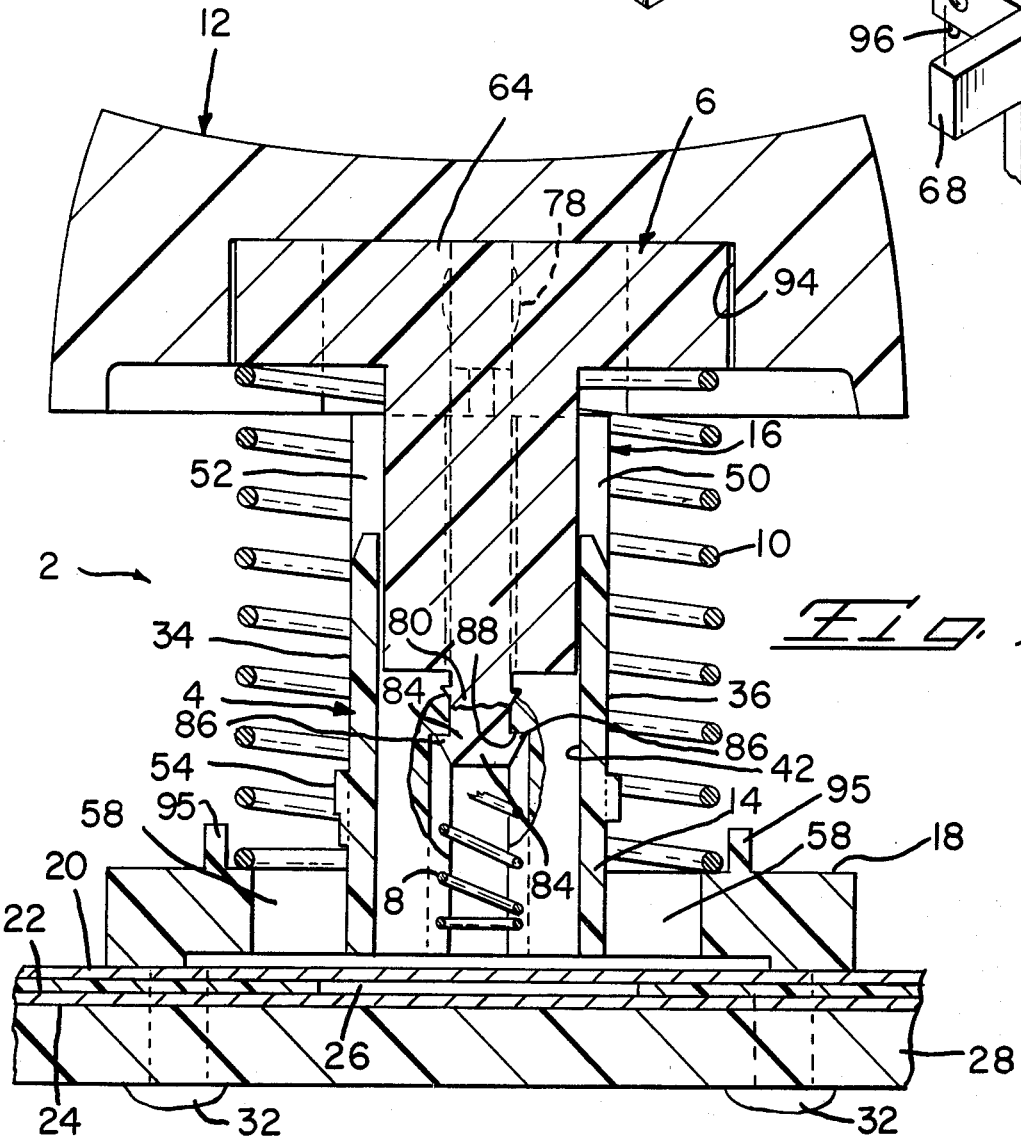
Fig. 5

SWITCH ACTUATING ASSEMBLY HAVING IMPROVED CAMS AND PLURAL MODES

FIELD OF THE INVENTION

This invention relates to switch actuating assemblies or closing assemblies of the type used to close keyboard switches such as membrane switches, Hall effect switches, or other types of switches. The invention is particularly directed to improved switch assemblies which provide for different operating modes.

BACKGROUND OF THE INVENTION

A variety of keyboard switch devices are commonly used for keyboard switches on typewriter keyboards or similar keyboards. The switches used may be membrane switches or other types, such as capacitance, or Hall effect switches.

The actuating assemblies used for such switches commonly comprise a frame, or housing, and a plunger which is slideably mounted in the frame such that when the plunger is depressed, the switch is closed. It is frequently a requirement that the switch provide a tactile effect for the operator; the term "tactile effect" is understood to mean that when the plunger is depressed, the operator experiences an abrupt decrease in the force required to depress the switch at an intermediate stage so that the operator is aware that the switch has been closed. Some keyboards provide the tactile effect while others do not; in the latter case, the force required to depress the plunger increases gradually and without an abrupt change. Many keyboards also require a shift lock type effect for one or more of the switch positions. When a shift lock key is depressed, the plunger is moved to its lowered position but its reverse movement is arrested by a mechanism on the actuator which holds the plunger in its depressed condition or a partially depressed condition. When the plunger is again depressed, the mechanism permits the plunger to return to its normal position.

Heretofore, it has been necessary for a keyboard switch manufacturer to use different actuator parts or to use different numbers of standard parts for the different modes of switch operation. In making an alpha numeric keyboard, for example, if the manufacturer would use one type of actuator for most of the key positions, such as the letters and numerals, the type of actuator used would be either a normal mode actuator (no tactile effect) or a tactile effect actuator. The manufacturer would, however, be required to use different plunger or frame parts for the shift lock keys of the keyboard. This requirement for different types of actuating mechanisms for the different operating modes has been burdensome in the past in that it required the manufacturer to design and obtain several different plunger or frame parts if he wished to produce a variety of types of keyboards.

The present invention is directed to the achievement of an improved keyboard switch actuator which comprises standard component parts which can be assembled to each other with the parts in one of several orientations and which will provide any one of the three desired operating modes (tactile effect, normal mode, shift lock) depending upon the orientations of the parts at the time of assembly. The invention is further directed to the achievement of a switch actuator comprising a reduced number of component parts which can be produced by molding processes.

A switch actuating assembly in accordance with the invention comprises a frame having a fixed end and a free end and a plunger mounted on the frame. The plunger has a lower end which is proximate to the fixed end of the frame and a force-receiving end which is proximate to the free end of the frame. The plunger is slideably mounted on the frame and is movable from a normal or extended position to a depressed position when force is applied to the force-receiving end of the plunger. The force-receiving end is located beyond the free end of the frame when the plunger is in the normal position and is moved towards the free end of the frame when the plunger is depressed. The lower end of the plunger is moved towards the fixed end of the frame when the plunger is moved to the depressed position. Spring means are provided which are resiliently stressed when the plunger is moved to the depressed position, the spring means being effective to return the plunger to the normal position when force is removed from the force-receiving end. The switch actuating assembly of the invention is particularly characterized in that the plunger has a deflectable camming arm connected thereto proximate to the force-receiving end, the cam arm extending towards the lower end of the plunger and having a cam following free end. A first cam is provided on the frame which is between the cam following free end of the plunger and the fixed end of the frame when the plunger is in the normal position so that the cam following free end of the camming arm engages the first cam when the plunger is moved to the depressed position with resulting deflection of the camming arm. The deflection of the camming arm results in an abrupt change in the force required to depress the plunger and a tactile effect is provided to the switch operator.

In accordance with a further embodiment, the frame has a second cam thereon which is spaced in an angular sense from the first cam, the plunger being capable of assembly to the frame while the plunger is in a first orientation or in a second orientation. The cam following free end of the camming arm engages the first cam when the plunger is assembled to the frame while in the first orientation and engages the second cam when the plunger is assembled to the frame while in the second orientation. The second cam is contoured to provide a shift lock mode of operation in that the second cam permits movement of the free end of the camming rod therepast to the depressed position from the normal position, and the second cam is also contoured to arrest movement of the cam when the plunger moves from the depressed condition to the normal position so that the plunger is held in an intermediate position which is close to the depressed position. The second cam is further contoured to permit passage of the cam following free end and return of the plunger to the normal position following movement of the plunger from the intermediate position to the depressed position.

In accordance with further embodiments, the frame has an axial opening extending therethrough from the free end towards the fixed end and the plunger has guide portions which are slideably received in the axial opening. The plunger is capable, in accordance with further embodiments, of assembly to the frame while the plunger is in a third orientation relative to the frame and the frame has a clearance opening for the cam following free end of the camming arm when the plunger is in the third orientation so that the plunger can be moved from the normal position to the depressed position without a tactile effect.

In accordance with further embodiments, at least three integral plunger arms extend radially from the guide portions of the plunger at the force receiving end, the camming arm being integral with, and extending from, one of the radially extending plunger arms and the camming arm being parallel to the guide portions of the plunger. The frame has radially extending slots extending from the axial opening at the free end of the frame, the plunger arms being dimensioned to enter the radially extending slots when the plunger is moved to the depressed position. The orientation of the plunger in this embodiment is determined by the association of the radially extending plunger arms and the radially extending slots.

In accordance with further embodiments, the frame and plunger are each one piece molded parts and the spring means comprises a larger diameter helical spring and a smaller diameter helical spring.

In accordance with further embodiments, the actuator comprises a frame member and a plunger member, and camming arm being on one of the members and the cams are on the other member.

DESCRIPTION OF THE DRAWINGS

FIG. 2 is a perspective view showing the underside of the key top exploded from the force-receiving end of the plunger.

FIGS. 5, 6, and 7 are views taken along the lines of 5—5, 6—6 and 7—7 of FIG. 3.

PREFERRED EMBODIMENT OF THE INVENTION

Figure 4:
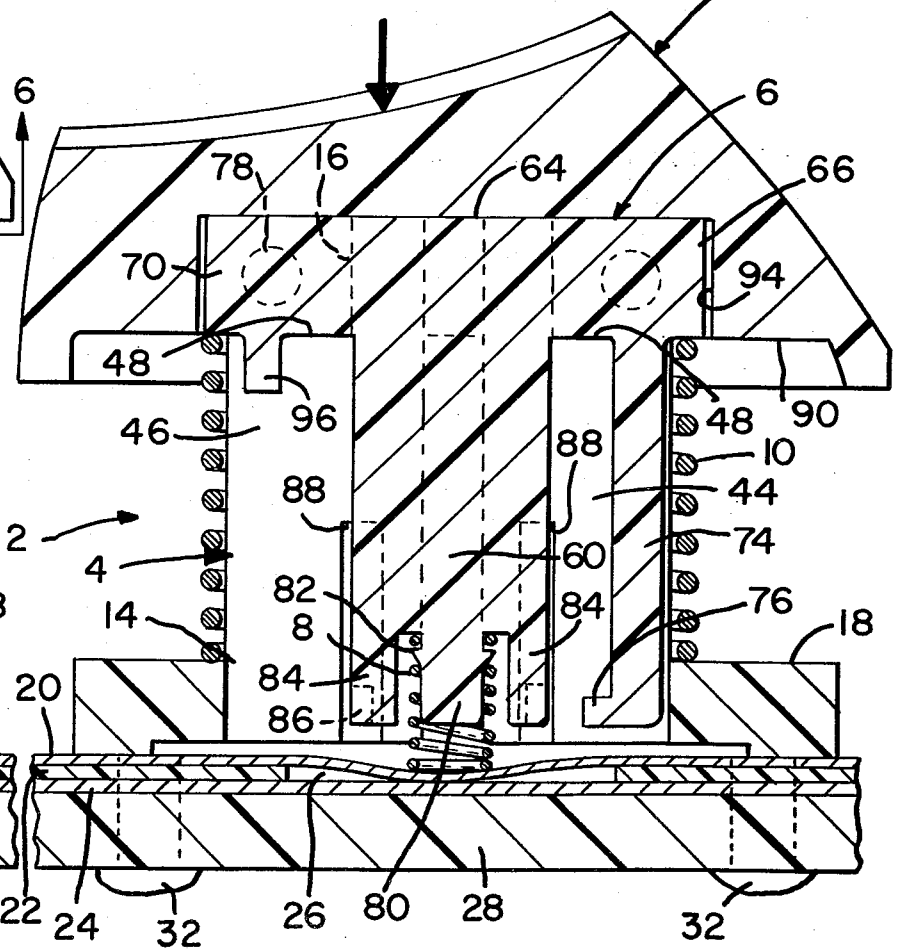
FIG. 4 is a view similar to FIG. 3 but showing the positions of the parts when the plunger is depressed.

As shown in FIGS. 1–4, a switch actuating assembly 2 in accordance with the invention comprises a frame 4, a plunger 6, an actuator spring 8, a return spring 10, and a key top 12. The plunger and frame may be produced by injection molding as one piece parts as shown in the drawing. The frame 4 has a lower or fixed end 14 and an upper or free end 16. A square base 18 is integral with the fixed end 14 and is disposed above a membrane switch, FIG. 3, comprising an upper film 20, a separator film 22, and a lower film 24. An opening 26 is provided in the separator film 22 so that the upper film can be flexed downwardly as shown in FIG. 4 and switch contacts on the upper film will contact switch contacts on the lower film 24. The membrane switch, in turn, is supported on a panel 28 and the assembly 2 is secured to the panel by mounting feet 30 which extend through the membrane switch and through the panel. These mounting feet are flattened as shown at 32 to hold the frame on the panel.

Figure 7:
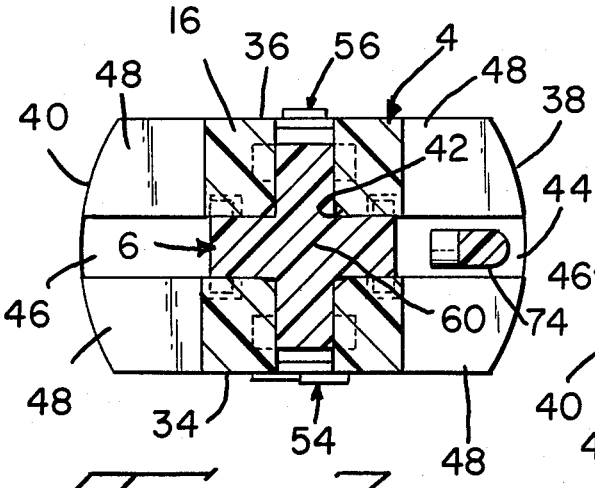

The frame 4 has parallel spaced-apart vertical side surfaces 34, 36 and cylindrical side surfaces 38, 40 as shown in FIG. 7. An axial opening 42, FIG. 5, extends through the frame from the free end 16 towards the fixed end 14. In addition, clearance openings 44, 46 extend into the side surfaces 38, 40 and provide clearance for a camming arm as described below. The upper portion of the frame adjacent to the free end 16 is stepped inwardly to form upwardly facing shoulders 48. Arm receiving slots 50, 52 are also provided which extend inwardly from the side surfaces 34, 36 and the upper portions of the openings 44, 46 also function as arm-receiving slots. These slots receive portions of plunger arms on the force receiving end of the plunger 6 as described below.

A cam 54 is integral with the side surface 34 and a cam 56, FIG. 7, is integral with the side surface 36. The base 18 has openings 58 therein adjacent to the fixed end of the frame and beneath the cams 54, 56. These openings are required in order to permit forming of the cams 54, 56 by the core pins when the base and frame are molded as a one piece part. The cams 54, 56 cooperate with a cam follower 76 and their structure is described below along with a description of their function.

The plunger 6 has a cruciform cross-section guide portion 60 which is received in, and which conforms to, the axial opening 42, see FIG. 7. The lower end 62 of the plunger is disposed in the opening 42 proximate to the fixed end 14 of the frame and the upper end 64 is normally disposed proximate to, but beyond, the free end 16 of the frame. The upper end 64 is herein referred to as a force-receiving end of the plunger in that it receives and transmits the force applied to the key top 12 when the plunger is depressed.

Four plunger arms 66, 68, 70, and 72 extend at 90° angular intervals radially from the force receiving end of the plunger. The outer ends of these arms extend at least to, or beyond, the sides 34, 36, 38, and 40 of the frame. The arm 66 has a cam follower arm 74 integral therewith adjacent to its outer end. This cam follower arm 74 extends downwardly as viewed in FIG. 1 and parallel to the guide portion 60 of the plunger. At its lower end, the arm 74 has an integral inwardly turned cam follower 76 which cooperates with the cams 54, 56. The arms 66, 70 also have integral locking bosses 78 on their surfaces which lock the arms in the key top 12 as described below.

The lower end 62 of the plunger has a coaxial cylindrical extension 80 having a pair of retaining ears 82 thereon which serves as retainers for the contact spring 8. The lower end of the plunger also has extensions 84 on opposite sides of the cylindrical extension 80. Locking ears 86 extend outwardly from the ends of these extensions and project beyond downwardly facing shoulders 88 provided in the axial opening 42 to retain the plunger in assembled relationship to the frame, see FIGS. 4 and 5. The contact spring 8 which is of a relatively small diameter is normally located on the extension 80 and its lower end is spaced from the surface of the upper membrane 20. When the plunger is decreased as shown in FIG. 4, the lower end of the contact spring 8 engages the upper member, pushes it downwardly, and thereby closes the switch.

As shown in FIG. 2, the key top 12 has an underside 90 in which there is provided a generally square frame-receiving recess 92 and a plurality of arm-receiving recesses 94 equal to the number of plunger arms. The sidewalls of the arm receiving recesses intersect the sidewalls of the frame receiving recess 92 and the arm-receiving recesses arm dimensioned and spaced such that they can receive the arms 66, 68, 70, and 72 when the plunger is in any one of at least three angular orientations relative to the key top.

The parts of the switch actuator can be assembled to each other by first assembling the contact spring 8 to the cylindrical projection 80, thereafter positioning the return spring 10 on the upper surface of the base 18, assembling the plunger 6 to the key top 12, and finally moving the assembled plunger and key top downwardly into the frame until the ears 86 are below the shoulders 88 on the frame. The return spring 10 is maintained in position by the retaining projections 95 and by a retainer 96 on the underside of the plunger arm 70. The return spring surrounds the camming arm 74 which also serves as a retainer and positioning means for the return spring.

When the plunger is depressed, portions of the plunger arms 64–72, which are adjacent to the axis of the plunger, are received in the arm receiving slots 50, 52 and in the upper portions of the clearance openings 42, 44. As shown in FIG. 4, the underside 90 of the key top 12 moves against the upwardly facing shoulders 48.

Figure 3:
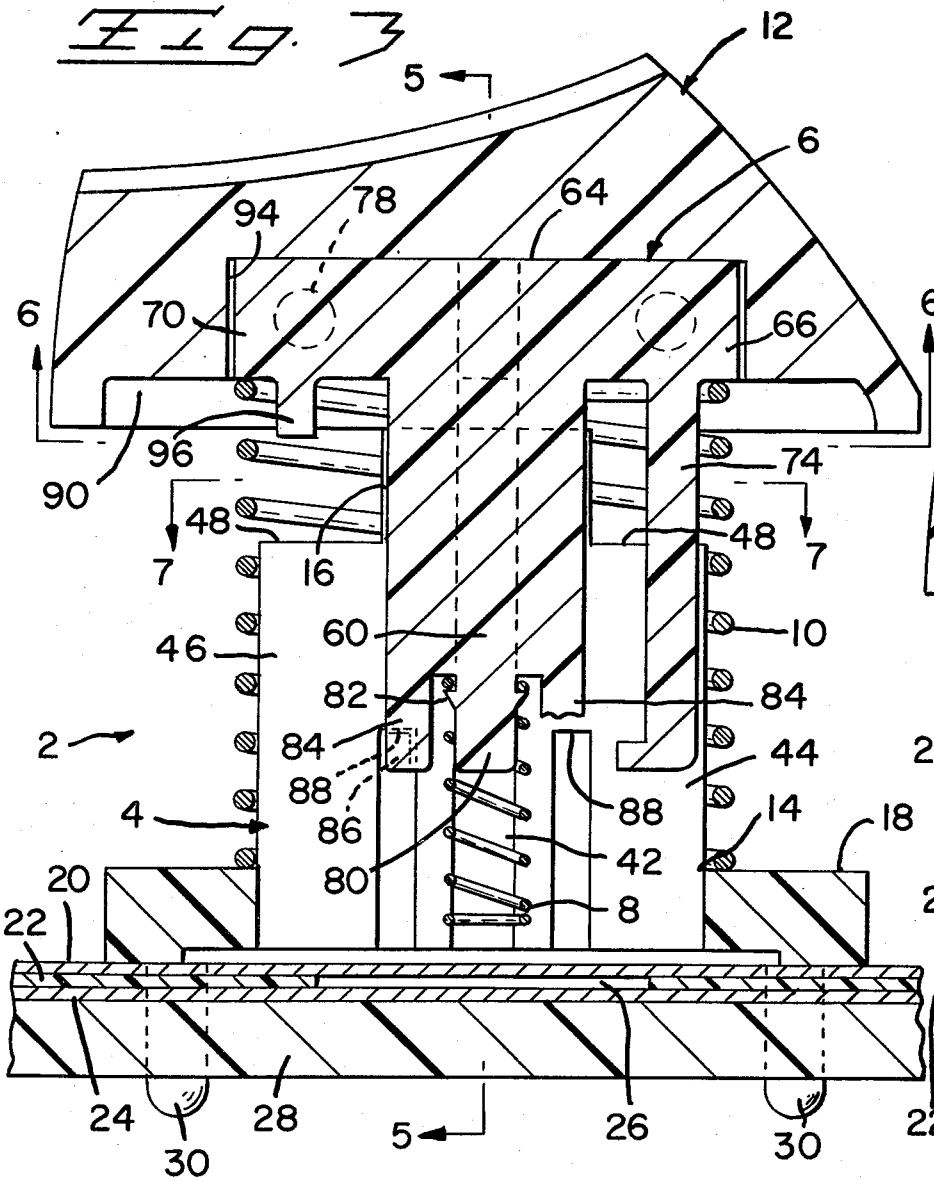
FIG. 3 is a cross-sectional side view of a switch actuating assembly mounted above a membrane switch on a panel, the parts being shown with the plunger in the normal, or raised, position.
Figure 6:
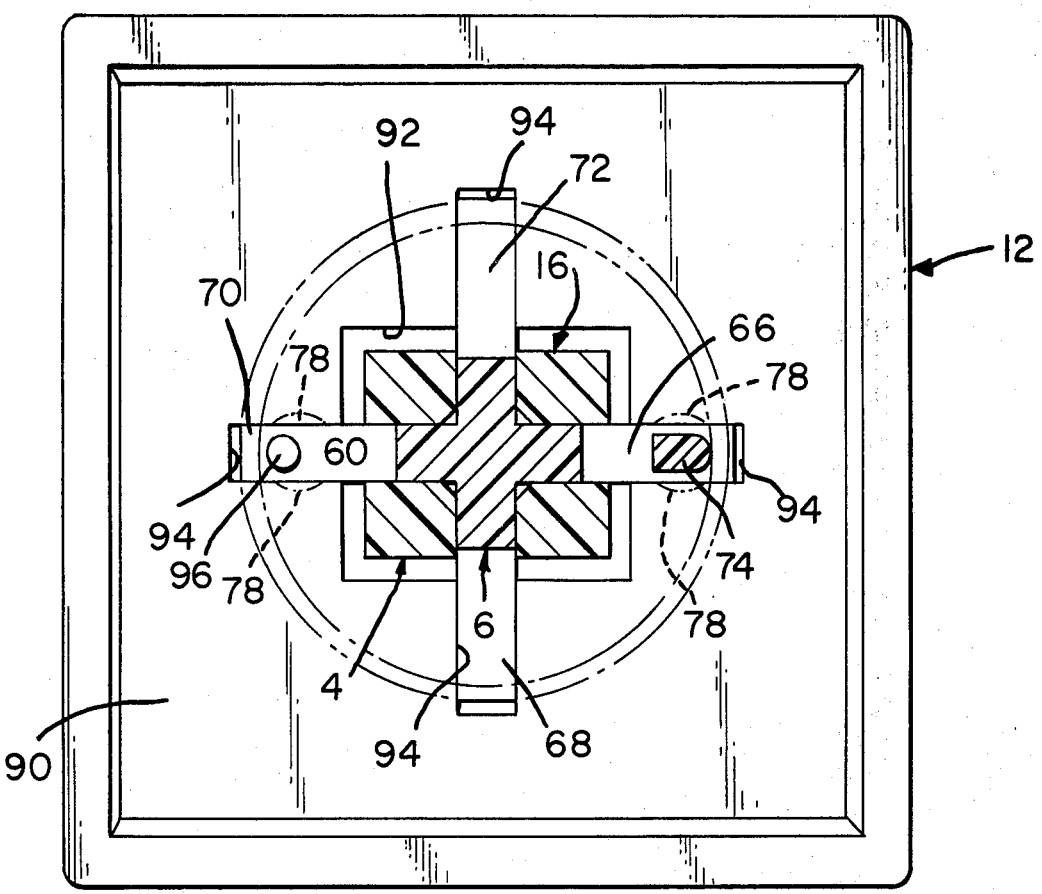

When the plunger and key top are assembled to the frame with the plunger in the orientation shown in FIGS. 1–5, the camming arm 74 will be received in the recess 44 and will be free to move from the position of FIG. 3 to the position of FIG. 4 without engaging either of the cams 54, 56. When the plunger is in the orientation, a normal operating mode is achieved so that when the operator depresses the plunger by pressing on the key top, the operator experiences a more or less gradual increase in the force required to depress the plunger. This mode, then, does not provide a tactile effect for the operator. As explained above, this mode is sometimes the desired operating mode.

Figure 1:
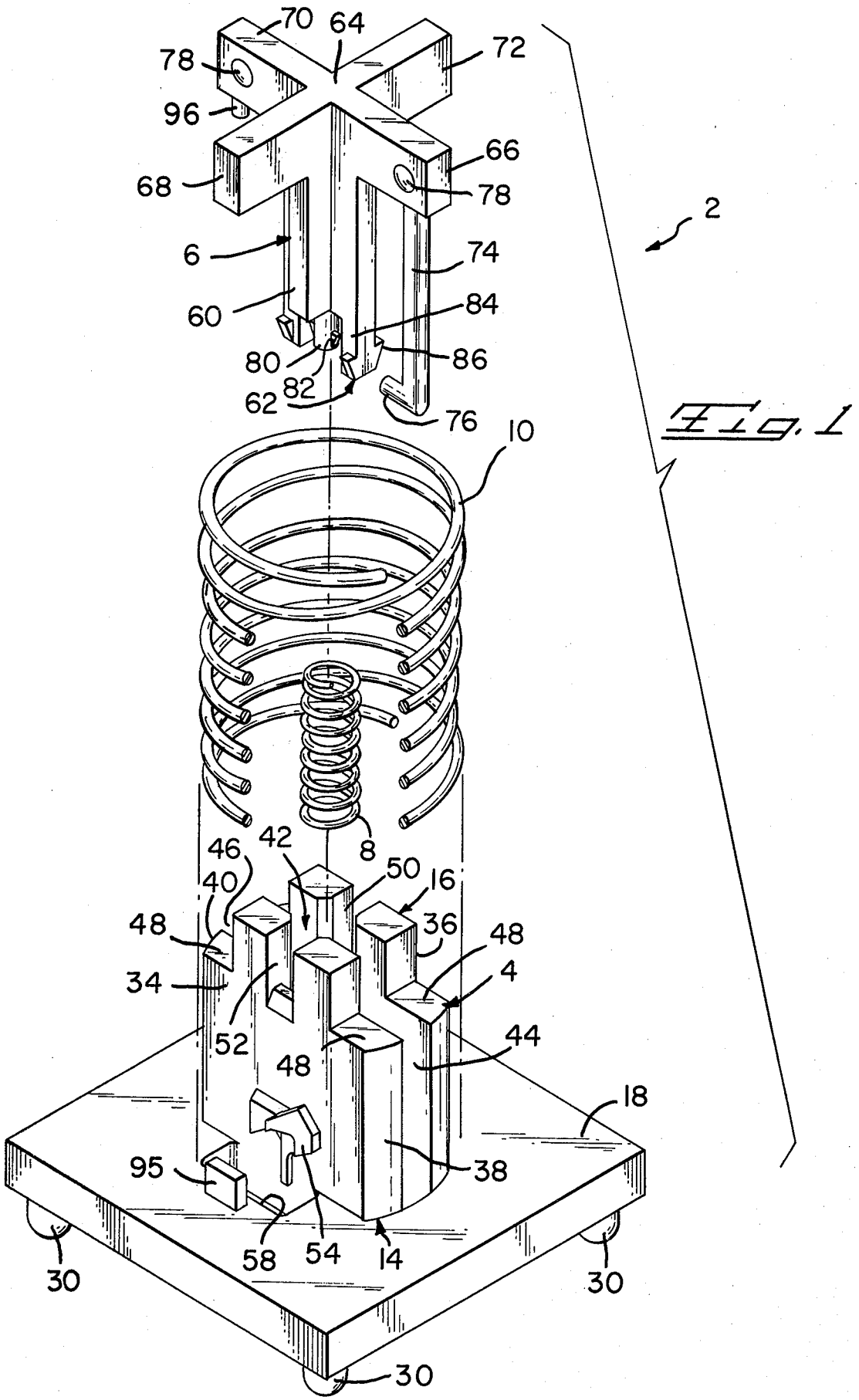
FIG. 1 is a perspective view of the essential parts of a switch actuating assembly in accordance with the invention showing the parts exploded from, and in alignment with, each other.
Figure 18:
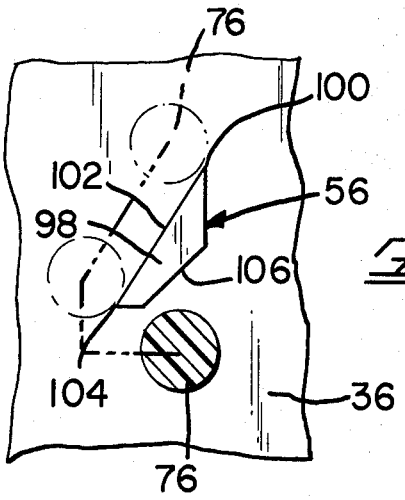
FIG. 18 is a view looking in the direction of the arrows 18—18 of FIG. 8 and showing the movement of the cam following free end of the camming arm past the tactile effect cam.

If a tactile effect is required, the plunger 6 is rotated counter-clockwise 90° from the orientation shown in FIG. 1 and assembled to the frame 4 so that the arm 66 will now be received in the arm receiving slot 50 when the plunger is depressed. When the parts are in this position, the cam follower 76 on the end of the camming arm 74 will engage the cam 56 on the surface 36. As shown in FIG. 18, the cam follower 76 will first contact the cam 56 at a location slightly to the left of the apex 100 of the cam and will move against a surface 102 that extends downwardly and leftwardly as viewed in FIG. 18. As the plunger moves downwardly, the cam follower 76 will move across the surface 102 as indicated by the dotted line positions of the cam follower 76 and the camming arm will thereby be flexed leftwardly as viewed in FIG. 18. This flexure of the camming arm will increase the amount of force required to depress the plunger for a brief period and this required increase in the force may be apparent to the operator. When the cam follower 76 moves past the lower end 104 of the cam 56, the camming arm will return to its normal position as shown by the solid line positions in FIG. 18 and there will be an abrupt decrease in the force exerted by the operator. This abrupt decrease provides the tactile effect. When the plunger returns to its normal position from its depressed position under the influence of the return spring 10, the follower 76 will move against the inclined surface 106 which will deflect the camming arm 74 rightwardly as viewed in FIG. 18. The plunger will then return to its normal position and the camming arm again will assume its normal position. It will be apparent from FIG. 18 that the camming surfaces 102, 104, and 106 extend normally of the surface 36 of the frame and these camming surfaces extend to a surface 98 which is parallel to the surface 36.

Figure 8:
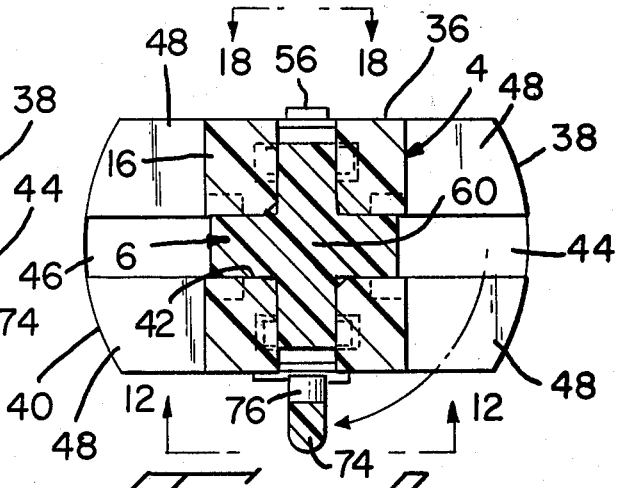
FIG. 8 is a view similar to FIG. 7, showing the plunger in a different orientation relative to the frame.

If it is desired to have the switch actuator assembly 2 function in the shift lock mode, it is merely necessary to rotate the plunger 90° in a clockwise direction from the position shown in FIG. 1 before assembling the plunger to the frame 4, see FIG. 8. When the plunger is so rotated, the camming arm 74 will extend beside the surface 34 of the frame and the cam follower 76 will move past, and cooperate with, the cam 54, as shown in FIGS. 12–16.

Figure 11:
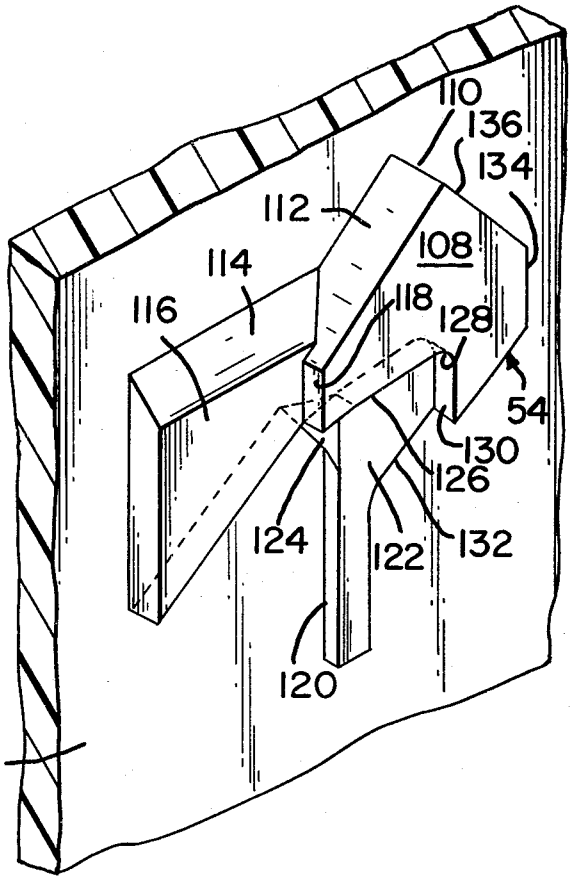
FIG. 11 is a perspective view of the shift lock cam from a vantage point displaced 90° from the vantage point of FIG. 10.
Figure 10:
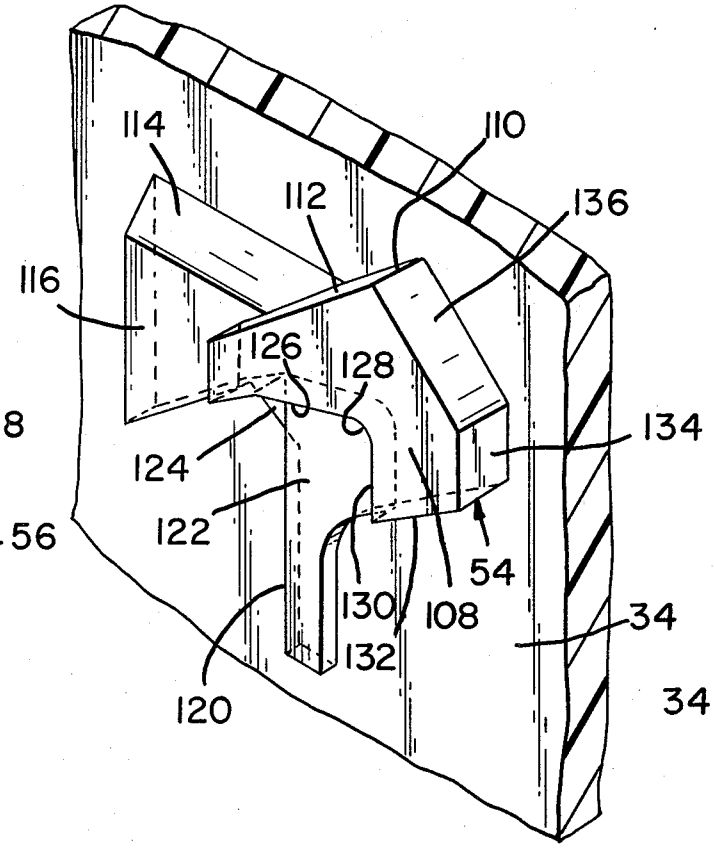
FIG. 10 is a perspective view of the shift lock cam.
Figure 9:
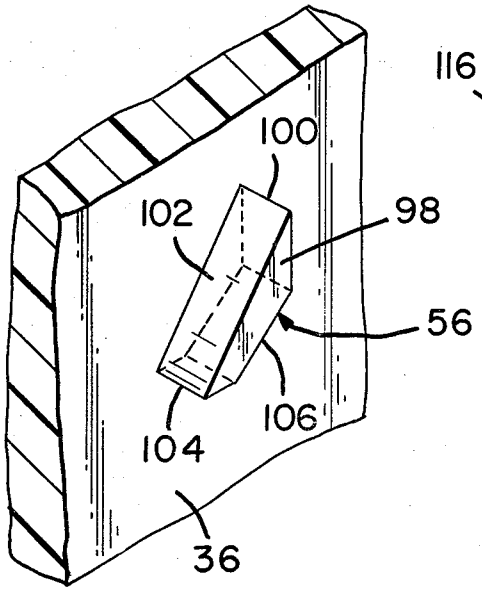
FIG. 9 is a perspective view of the tactile effect cam which is integral with the frame.
Figure 13:
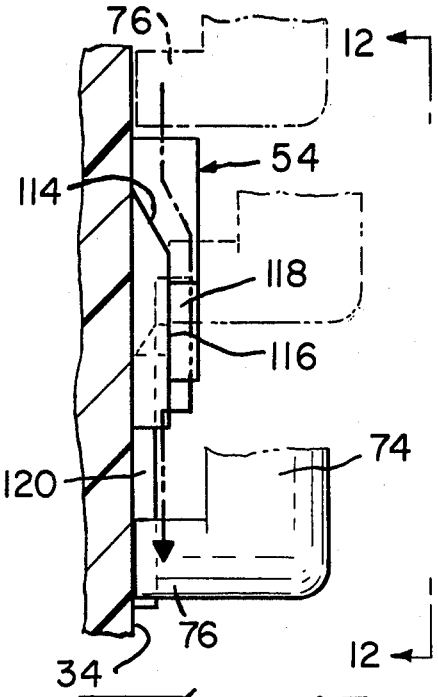
FIG. 13 is a view looking in the direction of the arrows 13—13 of FIG. 12.

The camming surfaces of the cam 54 can best be described with reference to their cooperation with the cam follower 76 when the plunger is depressed. In general, the cam 54 has an apex 110, a surface 108 which is parallel to, and spaced from, the surface 34 and additional parallel surfaces 116, 122 which are parallel to and between the surface 108 and the surface 34 with the surface 122 being closer to the surface 34 than the surface 116, see FIGS. 10 and 11.

Figure 12:
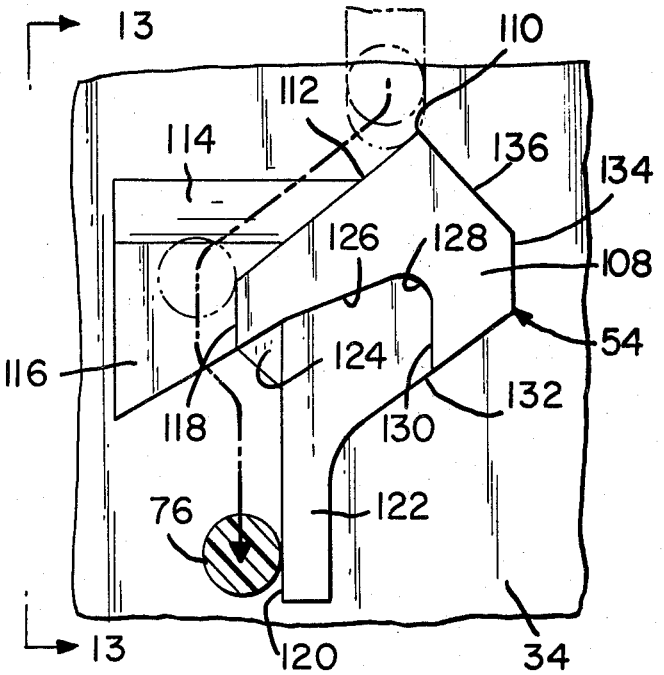
FIG. 12 is a view looking in the direction of the arrows 12—12 of FIG. 8 and illustrating the movement of the cam following free end of the camming arm past the shift locking cam when the plunger is moved from the normal position to the depressed position.
Figure 15:
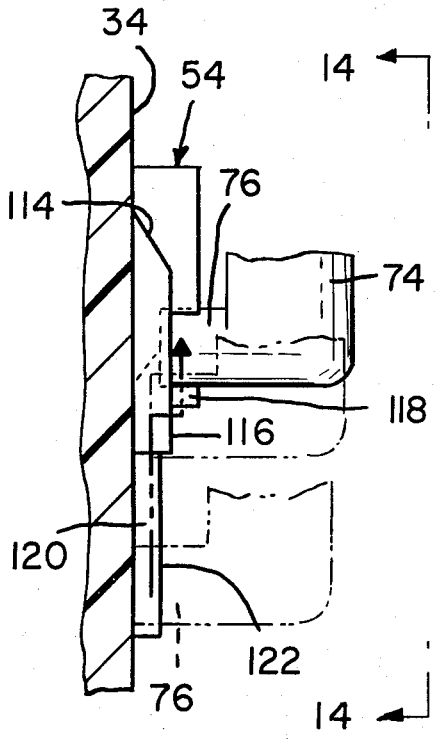
FIGS. 14 and 15 are views similar to FIGS. 12 and 13 illustrating the movement of the cam follower to the intermediate locked position.

When the plunger is depressed, the cam follower 76 engages the cam 54 to the left of the apex 110 as viewed in FIG. 12, and moves against a downwardly inclined camming surface 112 which is inclined leftwardly as viewed in FIG. 12. The surface 112 which extends normally of surface 34 merges with an inclined surface 114 that extends to the surface 116 which is parallel to the surface 34. The cam follower 76 is guided by the vertical surface 118 across the surface 116 during its downward movement and moves past the leftwardly inclined surface 124 and is then guided downwardly by a vertical surface 120, as shown in FIG. 12. It will be understood that the camming arm is flexed away from the surface 34 when it moves across the surface 116 but then returns towards the surface 34 when it moves past the surface 116. FIG. 12 shows, in the solid line position, the location of the follower 76 when the plunger is fully depressed. When the operator removes force from the key top, the return spring 10 causes the plunger to move upwardly so that the cam follower 76 follows the path shown in FIGS. 14 and 15 to a locking pocket 128. The cam follower moves upwardly, guided by surface 120, and is deflected rightwardly by surface 124 onto the surface 122. Again, the arm 74 is flexed outwardly and it bears against the surface 122 while it is guided by the upwardly inclined surface 126 into the pocket 128. When the parts are in the position of FIG. 14, the plunger will be held in an intermediate depressed position so that the membrane switch will be held in a closed condition.

Figure 14:
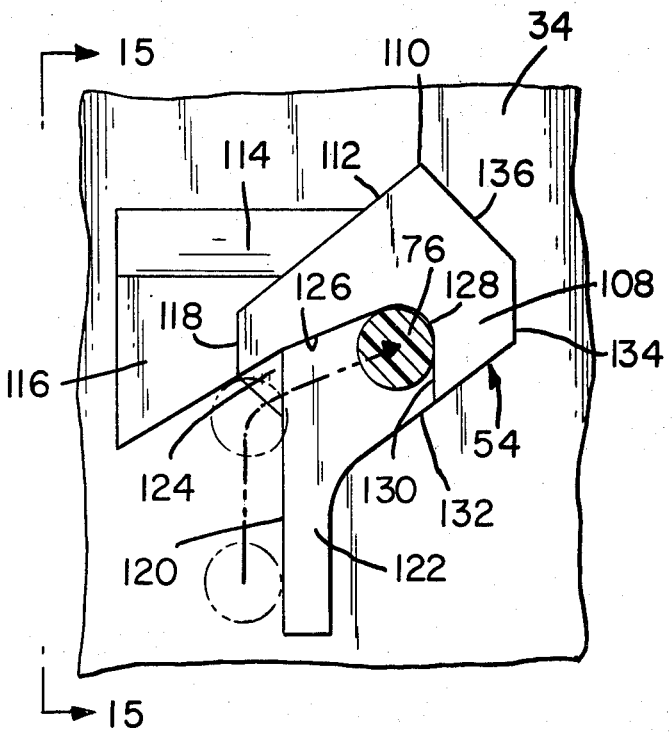
Figure 17:
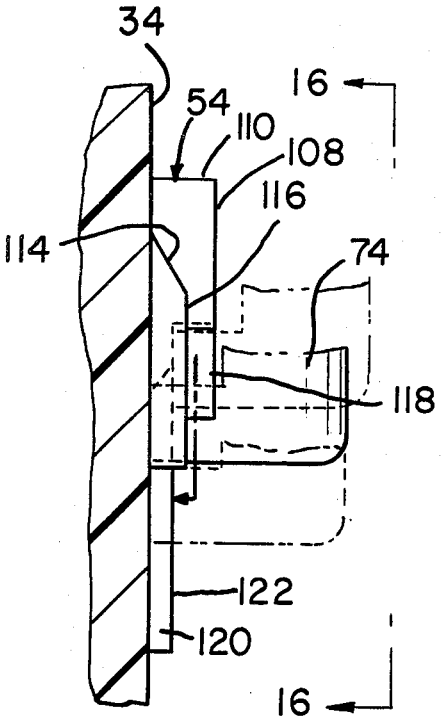
FIGS. 16 and 17 are views similar to FIGS. 12 and 13 illustrating the movement of the cam follower from the intermediate locked position to the normal position.
Figure 16:
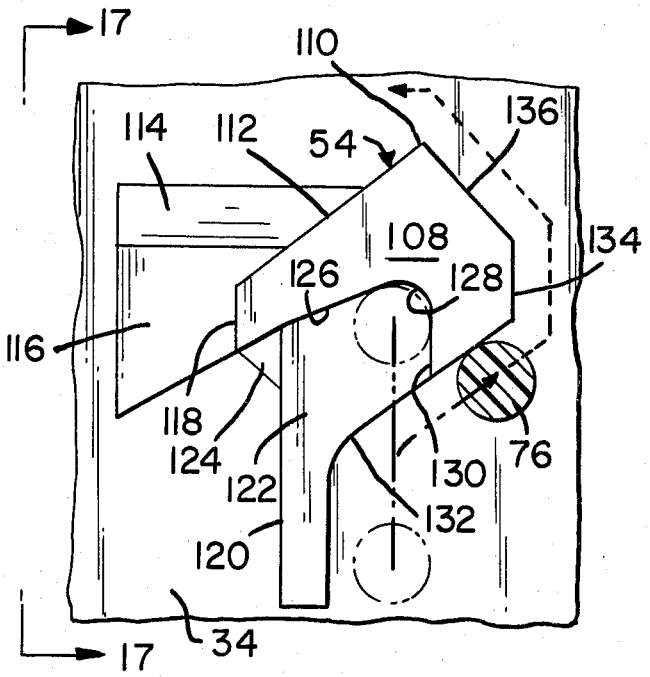

When the plunger is depressed again with the parts in the position of FIG. 14, it moves downwardly as shown in FIG. 16, past the surface 130 so that it then returns to its normal position or its unflexed position. When the operator again removes the force from the key top, the cam follower 76 is guided upwardly by the surface 132 and rightwardly to the surface 134 which extends vertically. The return spring returns the plunger to its normal position and the cam follower 76 moves along the surface 134, the leftwardly inclined surface 136 to the normal position.

A principal advantage of an actuating assembly in accordance with the invention is that two molded parts and the springs suffice to produce actuating assemblies having any one of the three operating modes commonly used in keyboard manufacture. This means that all of the key positions on an alpha numeric keyboard can be made with the same parts and it is only necessary to change slightly the orientation of the plunger relative to the frame for the shift locking positions. The remaining positions will usually either be all of the tactile effect type, or of the normal type, as explained above.

The principles of the invention can be used with switches other than membrane switches, as described herein, since these different operating modes are required regardless of the particular type of switch used. It will also be apparent that the camming arm might extend from the frame rather than the plunger and the cams formed on the plunger rather than the frame.

What is claimed is:

1. A switch actuating assembly of the type comprising a frame having a fixed end and a free end, a plunger mounted on the frame, the plunger having a lower end which is proximate to the fixed end of the frame and a force-receiving end which is proximate to the free end of the frame, the plunger being slideably mounted on the frame and being movable from a normal position to a depressed position when force is applied to the force-receiving end, the force-receiving end being located beyond the free end of the frame when the plunger is in the normal position, the force-receiving end being moved towards the free end of the frame and the lower end being moved towards the fixed end of the frame when the plunger is moved to the depressed position, and spring means which is resiliently stressed when the plunger is moved to the depressed position and which returns the plunger to the normal position when force is removed from the force-receiving end, the switch actuating assembly being characterized in that:

the plunger has a deflectable camming arm connected thereto proximate to the force-receiving end, the camming arm extending towards the lower end of the plunger and having a cam following free end, a first cam and a second cam are provided on the frame, the first cam and the second cam being between the cam following free end and the fixed end of the frame when the plunger is in the normal position, the first cam and the second cam being spaced apart in an angular sense on the frame, the plunger being capable of assembly to the frame while the plunger is in first or second angular orientation relative to the frame, the cam following free end of the camming arm being engageable with the first cam when the plunger is assembled to the frame while in the first angular orientation, the cam following free end of the camming arm being engageable with the second cam when the plunger is assembled to the frame while in the second angular orientation, the second cam being contoured to permit movement of the cam following free end of the camming arm therepast when the plunger is moved to the depressed position from the normal position and being contoured to arrest movement of the cam following free end when the plunger is moved from the depressed position to the normal position so that the plunger is held in an intermediate position, the second cam being contoured to permit passage of the cam following free end and return of the plunger to the normal position following movement of the plunger from the intermediate position to the depressed position, the first cam being contoured to require an abrupt increase in force to depress the plunger and thereby provide a tactile effect to the operator.

2. A switch actuating assembly as set forth in claim 1 characterized in that the frame has an axial opening extending therethrough from the free end towards the fixed end, the plunger having guide portions which are slideably received in the axial opening.

3. A switch actuating assembly as set forth in claim 2 characterized in that the plunger is capable of assembly to the frame while the plunger is in a third angular orientation relative to the frame, the frame having clearance for the cam following free end of the camming arm when the plunger is in the third angular orientation whereby the plunger can be moved from the normal position to the depressed position without a tactile effect.

4. A switch actuating assembly as set forth in claim 3 characterized in that at least three integral plunger arms extend radially from the guide portions of the plunger at the force-receiving end thereof, the camming arm being integral with, and extending from one of the radially extending plunger arms and being parallel to the guide portions of the plunger, the frame having radially extending slots extending from the axial opening at the free end of the frame portion, the plunger arms being dimensioned to enter the radially extending slots when the plunger is moved to the depressed position, the orientation of the plunger being determined by the association of the radially extending plunger arms and the radially extending slots.

5. A switch actuating assembly as set forth in claim 4 characterized in that the frame and the plunger are each one piece molded parts.

6. A switch actuating assembly as set forth in either of claims 1 or 5 characterized in that the spring means comprises a larger diameter helical spring disposed in surrounding relationship to the frame.

7. A switch actuating assembly as set forth in claim 6 characterized in that the spring means further comprises a smaller diameter helical spring which is in alignment with the plunger at the lower end thereof, the smaller diameter spring being compressed during movement of the plunger to the depressed position and being effective, when compressed, to close switch contacts.

8. A switch actuating assembly as set forth in claim 7 characterized in that the actuating assembly is mounted on a membrane switch which is closed when the plunger is moved to the depressed position.

9. A switch actuating assembly as set forth in claim 4 characterized in that the frame has oppositely facing first and second side surfaces extending from the free end thereof towards the fixed end, the first and second cams being on the first and second side surfaces.

10. A switch actuating assembly of the type comprising a frame member having a fixed end and a free end, a plunger member mounted on the frame member, the plunger member having a lower end which is proximate to the fixed end of the frame member and a force-receiving end which is proximate to the free end of the frame member, the plunger member being slideably mounted on the frame member and being movable from a normal position to a depressed position when force is applied to the force-receiving end, the force-receiving end being located beyond the free end of the frame member when the plunger member is in the normal position, the force-receiving end being moved towards the free end of the frame member and the lower end being moved towards the fixed end of the frame member when the plunger member is moved to the depressed position, and spring means which is resiliently stressed when the plunger member is moved to the depressed position and which returns the plunger member to the normal position when force is removed from the force-receiving end, the switch actuating assembly being characterized in that:

one of the members has a deflectable camming arm integral therewith and the other member has first and second cams thereon, the cams being spaced-apart in an angular sense on the other member, the plunger member and the frame member being capable of assembly to each other while they are in a first angular orientation relative to each other, the camming arm being engageable with the first cam during movement of the plunger member to the depressed condition when the members are assembled to each other while in the first angular orientation, the first cam and the camming arm providing a tactile effect when the plunger is moved to the depressed position, the plunger member and the frame member being capable of assembly to each other while they are in a second angular orientation relative to each other, the camming arm being engageable with the second cam during movement of the plunger member to the depressed condition when the members are assembled to each other while in the second angular orientation, the second cam and the camming arm providing a shift lock effect.

11. A switch actuating assembly as set forth in claim 10 characterized in that the camming arm is on the plunger member and the first and second cams are on the frame member.

12. A switch actuating assembly as set forth in either of claims 10 or 11 characterized in that the frame member has an axial opening extending therethrough from the free end towards the fixed end.

13. A switch actuating assembly as set forth in claim 12 characterized in that the plunger member and the frame member are each one piece molded parts.

* * * * *